US008813853B1

(12) United States Patent
Peterson et al.

(10) Patent No.: US 8,813,853 B1
(45) Date of Patent: Aug. 26, 2014

(54) TEMPORARY ABANDONMENT CAP

(71) Applicants: Matthew Charles Peterson, Houston, TX (US); Rick Graff, Houston, TX (US)

(72) Inventors: Matthew Charles Peterson, Houston, TX (US); Rick Graff, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/803,113

(22) Filed: Mar. 14, 2013

(51) Int. Cl.
*E21B 33/037* (2006.01)
*E21B 33/00* (2006.01)

(52) U.S. Cl.
CPC ..... *E21B 33/00* (2013.01)
USPC ..... 166/351; 166/368; 166/75.13

(58) Field of Classification Search
CPC ..... E21B 33/037; E21B 33/0375
USPC ..... 166/351, 338, 368, 96.1, 97.1, 75.13; 138/89; 405/42
See application file for complete search history.

(56) References Cited

U.S. PATENT DOCUMENTS 2,605,847 A * 8/1952 McCoy ..... 166/54
3,998,245 A * 12/1976 Martin ..... 138/89
5,107,931 A * 4/1992 Valka et al. ..... 166/342
5,992,526 A * 11/1999 Cunningham et al. ..... 166/343
6,474,416 B2 * 11/2002 Beall et al. ..... 166/343
6,494,257 B2 * 12/2002 Bartlett et al. ..... 166/86.2
6,494,266 B2 * 12/2002 Bartlett et al. ..... 166/339
6,502,632 B1 * 1/2003 Pittman ..... 166/75.13
6,615,923 B1 * 9/2003 Lay et al. ..... 166/368
6,845,815 B2 * 1/2005 Hergarden et al. ..... 166/92.1
7,051,804 B1 * 5/2006 Arning ..... 166/97.1
7,325,598 B2 * 2/2008 Bartlett ..... 166/75.13
7,621,338 B2 * 11/2009 Wenham et al. ..... 166/343
7,621,340 B2 * 11/2009 Cuthill et al. ..... 166/379
7,637,325 B2 * 12/2009 Goonetilleke et al. ..... 166/368
7,677,319 B2 * 3/2010 Baskett ..... 166/360
8,047,295 B2 * 11/2011 Skeels et al. ..... 166/348
8,087,465 B2 * 1/2012 Huang et al. ..... 166/339
2002/0185279 A1 * 12/2002 Blair et al. ..... 166/335
2011/0048726 A1 * 3/2011 Aarnes et al. ..... 166/339
2014/0060849 A1 * 3/2014 Pathak et al. ..... 166/344

FOREIGN PATENT DOCUMENTS

GB 2405883 A * 3/2005 ..... E21B 33/037

* cited by examiner

*Primary Examiner* — Matthew Buck
(74) *Attorney, Agent, or Firm* — Parul Anderson

(57) ABSTRACT

Temporary abandonment caps include a cap body having an opening therethrough, and an inner sleeve that provides access to the wellbore, where the inner sleeve can be accessed through the opening in the cap body when a removable cover is removed. The inner sleeve also includes an injection port and a channel through which fluids for protecting the wellhead can be injected. The temporary abandonment caps can remain in place while performing well operations and ensuring that the sealing surfaces on a wellhead remain protected from corrosion.

21 Claims, 8 Drawing Sheets

TEMPORARY ABANDONMENT CAP

TECHNICAL FIELD

The present disclosure relates generally to apparatus for the protection of subsea wellheads of offshore wells, and more particularly, to temporary abandonment caps that allow for access to the wellbore while the cap is in place.

BACKGROUND

When drilling and/or completing offshore oil and gas wells, there may be many occasions, both planned and unexpected, where it is desirable to temporarily suspend drilling or completion activities at the well. As part of this process, a temporary abandonment cap is installed to aid in protecting the wellhead during this period of inactivity. Typically, a portion of the wellbore will be filled with a liquid corrosion inhibitor to displace the seawater within the bore such that certain surfaces, e.g., sealing surfaces, are not corroded by the seawater or otherwise subjected to the formation of undesirable marine growth, e.g., algae. The temporary abandonment cap is used in an effort to keep the corrosion inhibitor fluid in the bore until such time as it is desired to resume drilling and/or completion activities at the well. However, conventional temporary abandonment caps do not allow for access to the wellbore while the cap is in place. Conventional temporary abandonment caps must be removed while operations that require access to the wellbore take place, thus leaving sealing areas of the wellhead open and susceptible to damage. Damage to these sealing areas can potentially result in the loss of the well and the inability to use well control equipment, as it would be irreparable and prevent proper sealing of a blow out preventer.

SUMMARY

The present application is directed to temporary abandonment caps that provide protection of a subsea structure of a wellbore while allowing access to the wellbore during operations. The present application is also directed to methods of utilizing such caps.

In one aspect of the invention, a temporary abandonment cap, or debris cap, for covering an open upper end of a subsea structure of a wellbore includes an outer body having a cavity and sized to fit over the subsea structure, a cap body coupled to one end of the outer body and having an opening extending therethrough, an inner sleeve positioned within the cavity of the outer body and coupled to the cap body, and a removable cover, or junk cap, for covering the opening of the cap body. The inner sleeve includes an injection port for receiving a fluid, such as an anti-corrosion fluid, and a channel through which the fluid flows. The wellbore engages the spacing between the inner sleeve and the outer body, and the fluid flows through the inner sleeve-wellbore interface and the outer body-wellbore interface. The inner sleeve also includes a hollow portion, wherein the opening of the cap body provides access to the hollow portion of the inner sleeve and thereby provides access to the wellbore when the removable cover is taken off.

In another aspect, a method for protecting an open upper end of a subsea structure of a wellbore utilizing the temporary abandonment caps of the present invention includes positioning the cap above the open upper end of the subsea structure, lowering the cap onto the subsea structure such that the subsea structure engages the spacing between the inner sleeve and the outer body, and the hollow portion of the inner sleeve provides access to the wellbore, inserting a fluid, such as an anti-corrosion fluid, into the injection port of the inner sleeve, whereby the fluid travels through the channel in the inner sleeve, out an exit port, up through the interface of the inner sleeve and subsea structure, and thereby displaces a lighter density fluid, such as seawater, which flows down through the interface of the subsea structure and outer body and out of the cap. The removable cover can be taken off to provide access to the wellbore, while protecting the subsea structure.

These and other aspects, objects, features, and embodiments will be apparent from the following description and the appended claims.

BRIEF DESCRIPTION OF THE DRAWINGS

For a more complete understanding of the exemplary embodiments of the present invention and the advantages thereof, reference is now made to the following description in conjunction with the accompanying drawings, which are briefly described as follows.

DETAILED DESCRIPTION

Figure 1A:
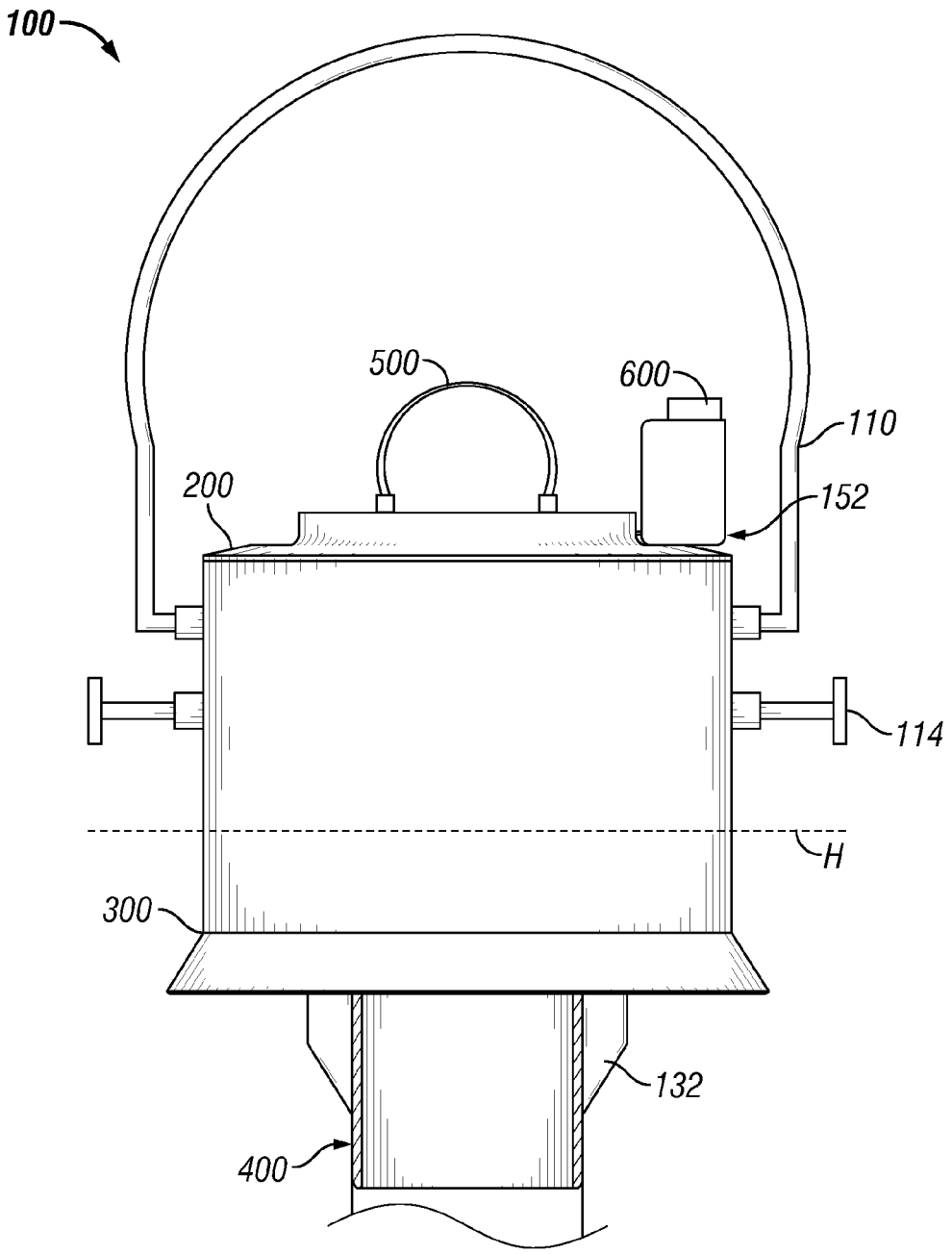
FIG. 1A is a side view of a temporary abandonment cap, according to an exemplary embodiment.

Illustrative embodiments of the invention are described below. In the interest of clarity, not all features of an actual implementation are described in this specification. One of ordinary skill in the art will appreciate that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. The elements and features shown in the drawings are not necessarily to scale, emphasis instead being placed upon clearly illustrating the principles of the example embodiments. Additionally, certain dimensions or positionings may be exaggerated to help visually convey such principles.

The present invention may be better understood by reading the following description of non-limitative embodiments with reference to the attached drawings wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for example, a meaning other than that understood by skilled artisans, such a special definition will be expressly set forth in the specification in a definitional manner that directly and unequivocally provides the special definition for the term or phrase.

Figure 1B:
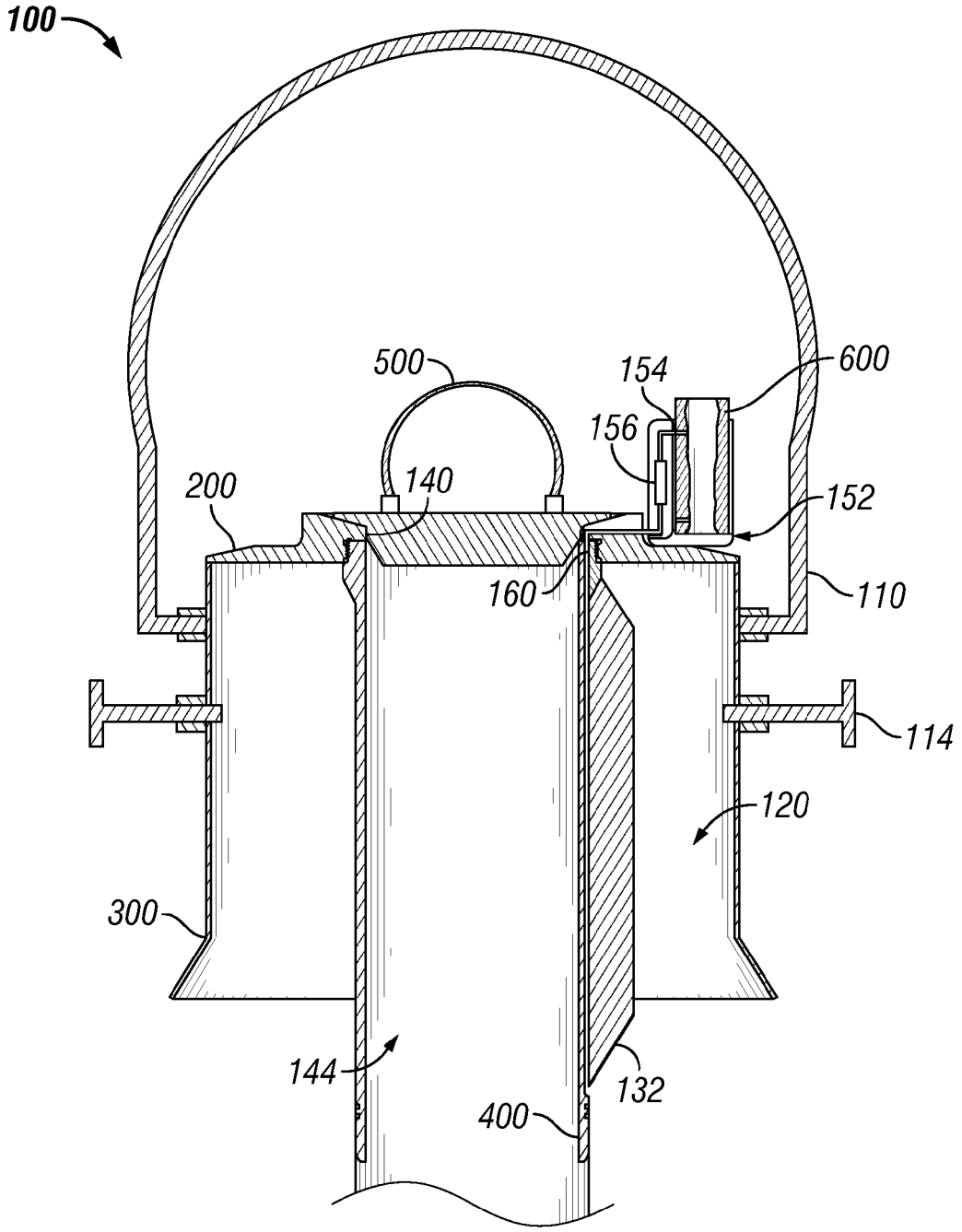
FIG. 1B is a side cross-sectional view of the temporary abandonment cap of FIG. 1A, according to an exemplary embodiment.
Figure 5:
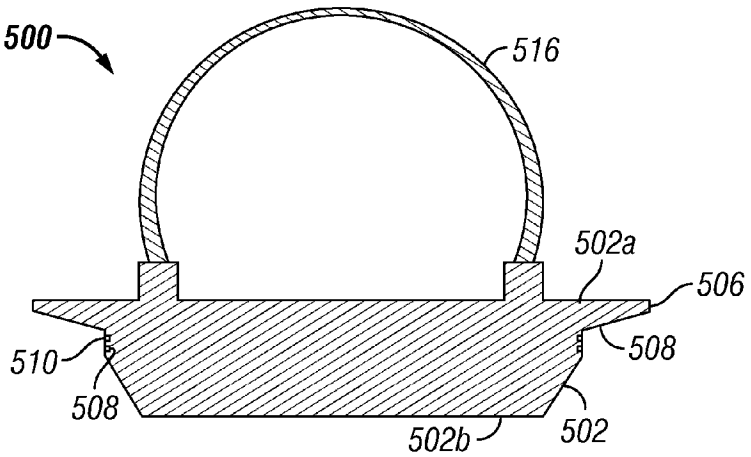
FIG. 5 is a side cross-sectional view of a junk cap of the temporary abandonment cap of FIG. 1A, according to an exemplary embodiment.
Figure 6:
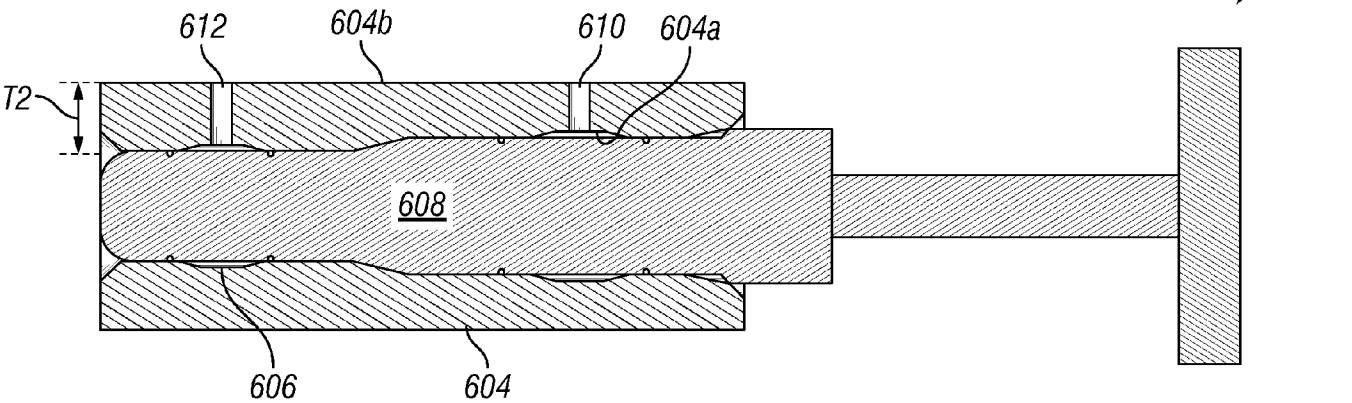
FIG. 6 is a side cross-sectional view of a hot stab interface of the temporary abandonment cap of FIG. 1A, according to an exemplary embodiment.

Referring now to FIGS. 1A-1B, an exemplary embodiment of a debris cap or temporary abandonment cap 100 for the protection of a subsea wellhead is shown. The temporary abandonment cap 100 includes a cap body 200 (FIGS. 2A-2B), an outer body 300 (FIG. 3), an inner sleeve 400 (FIGS. 4A-4B), a junk cap 500 (FIG. 5), and a hot stab interface or receptacle 600 (FIG. 6). The physical size of the temporary abandonment cap 100 may vary depending upon the application. While the temporary abandonment cap 100 has a cross-section along a horizontal H (FIG. 1A) that is generally circular, one having ordinary skill in the art will recognize that the cross-section can be any shape, such as oval, square, rectangular, irregular-shaped, etc, that covers the open end of a subsea structure. Generally, the temporary abandonment cap 100 is constructed from materials having a sufficient hardness to accommodate the water depth for a given application, and exhibit resistance to degradation in seawater. Suitable examples of materials of construction include, but are not limited to, carbon steel, coated steel, aluminum, corrosion-resistant materials, composite materials, elastomers, plastics made from resins, fiberglass, polyethylene, polyurethane, or other high density plastics, thermoplastic polymers, and materials having epoxy-coatings thereon.

The outer body 300 is generally cylindrical and configured to receive the inner sleeve 400 therein. A movable handle 110 is coupled to the outer body 300 to allow a remotely operated vehicle or user (not shown) to grasp the temporary abandonment cap 100. The size, shape, and configuration of the handle 110 can vary, and can be an inverted U-shaped member, a T-handle, a ring, a ball, or any other design that would allow the remotely operated vehicle or user to manipulate the temporary abandonment cap 100. The outer body 300 includes a locking mechanism for engaging and locking with a wellhead (not shown). In certain exemplary embodiments, the locking mechanism includes locking pins 114 operatively coupled to the outer body 300 for engaging the wellhead. Generally, the locking mechanism includes any locking mechanism that can be manipulated readily by a remotely operated vehicle.

The cap body 200 is coupled to the circumferential edge of the outer body 300 at one end of the outer body 300. The cap body 200 is also coupled to the inner sleeve 400 and holds the inner sleeve 400 in place within the outer body 300 such that a spacing 120 (FIG. 1B) is present between the inner sleeve 400 and the outer body 300. The spacing 120 is configured to engage a wellhead. The inner sleeve 400 includes centralizing wings 132 for centralizing the components of the temporary abandonment cap 100 once coupled to a wellhead. The cap body 200 also includes an opening 140 (FIG. 1B) configured to receive the junk cap 500 and extending therethrough to provide access to an interior space 144 (FIG. 1B) of the inner sleeve 400. The size, shape, and configuration of the opening 140 may vary.

A hot stab carrier 152 is coupled to an exterior of the cap body 200 and configured to receive the hot stab receptacle 600. The relative location of hot stab carrier 152 may be varied depending upon the application. The hot stab receptacle 600 is configured to receive a hot stab for injecting fluids into a port 154 (FIG. 1B). The hot stab carrier 152 is designed to allow fluid (not shown) placed in the hot stab receptacle 150 to flow from the port 154 to a check valve 156 (FIG. 1B) and into an injection port 160 (FIG. 1B) in the inner sleeve 400.

Figure 2A:
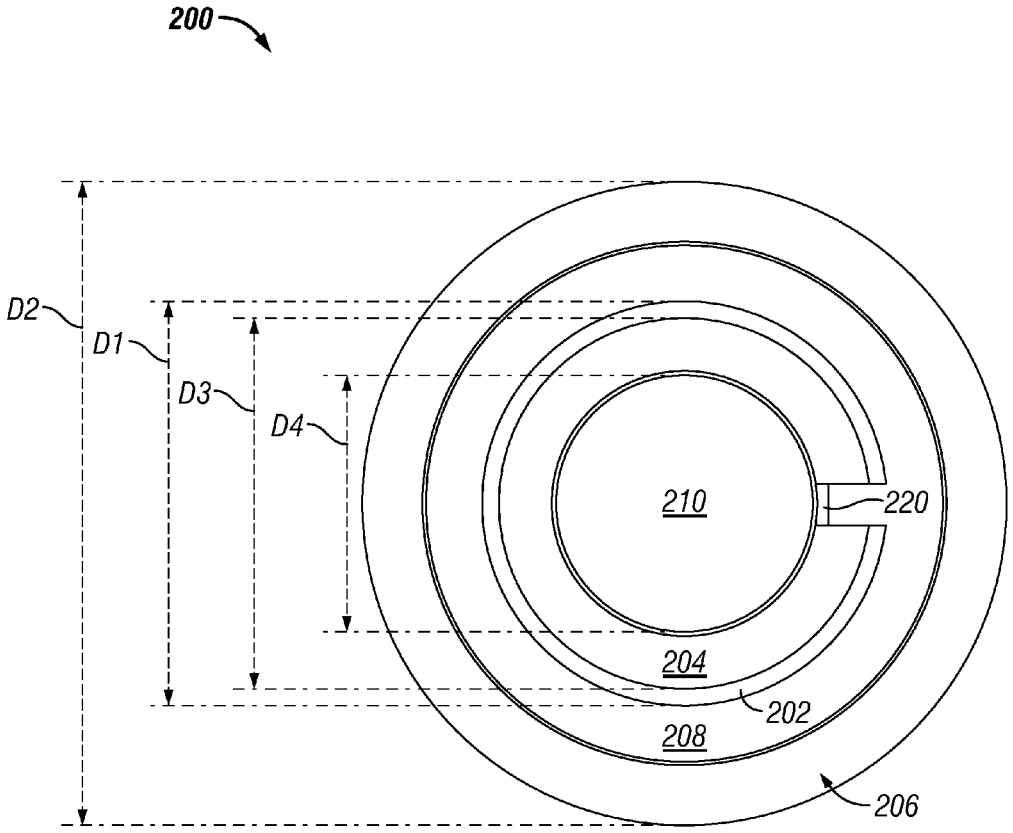
FIG. 2A is a top view of a cap body of the temporary abandonment cap of FIG. 1A, according to an exemplary embodiment.
Figure 2B:
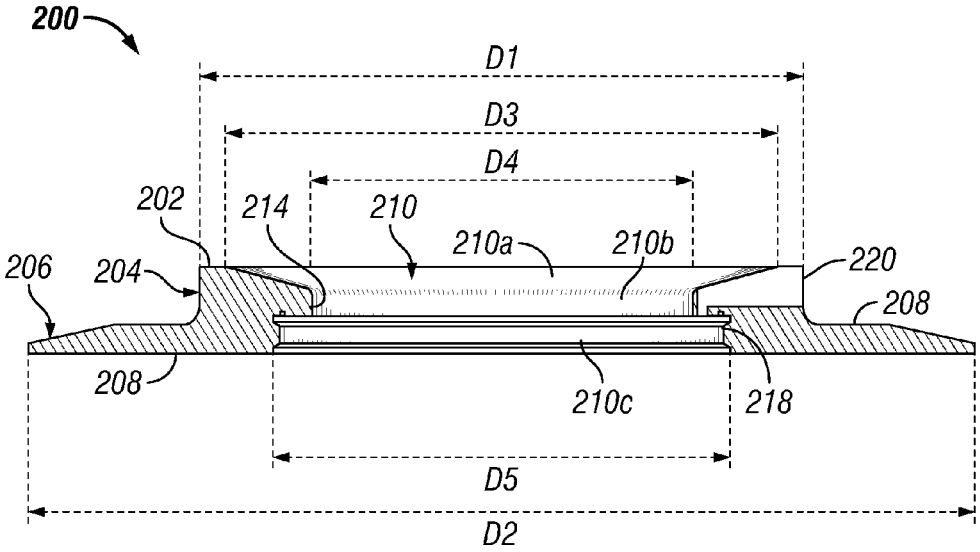
FIG. 2B is a side cross-sectional view of the cap body of FIG. 2A, according to an exemplary embodiment.

Referring to FIGS. 2A and 2B, an exemplary embodiment of a cap body 200 of the present invention is shown. The cap body 200 has top surface 202, an upper portion 204, a lower portion 206 adjacent to the upper portion 204, and bottom surface 208 (FIG. 2B) opposite from the top surface 202. In certain exemplary embodiments, the upper portion 204 has an outer diameter D1 less than an outer diameter D2 of the lower portion 206. The upper portion 204 of the cap body 200 includes a notch 220 for receiving tubing 710 (FIG. 7B) from the hot stab carrier 152 (FIGS. 1A-1B) to the injection port 160 of the inner sleeve 400 (FIG. 4B). The lower portion 206 includes a seat 208 on which the hot stab carrier 152 sits. In certain exemplary embodiments, the hot stab carrier 152 is mechanically coupled to the cap body 200. In other embodiments, the hot stab carrier 152 is welded to the cap body 200. In yet other embodiments, the hot stab carrier 152 is an integral component of the cap body 200.

An opening 210 extends from the top surface 202 through the upper and lower portions 204, 206, to the bottom surface 208. The size, shape, and configuration of the opening 210 may vary. In certain exemplary embodiments, the opening 210 has a top portion 210*a*, a middle portion 210*b*, and a bottom portion 210*c* (FIG. 2B). The top portion 210*a* of the opening 210 has a diameter D3 at the top surface 202 of the cap body 200, and tapers to diameter D4 at the middle portion 210*b*. The middle portion 210*b* is generally cylindrical. Generally, the top and middle portions 210*a*, 210*b*, of the opening 210 are configured to engage junk cap 500 (FIG. 5). In certain exemplary embodiments, the middle portion 210*b* of the opening 210 includes a sealing element 214 (FIG. 2B) for sealingly engaging the junk cap 500. The bottom portion 210*c* of the opening 210 is generally cylindrical and has a diameter D5 (FIG. 2B), where diameter D5 is greater than diameter D4 of the middle portion 210*b*. The bottom portion 210*c* is open to the notch 220, thus allowing the tubing 710 to extend from the notch 220 to the injection port 160. The bottom portion 210*c* also includes threads 218 (FIG. 2B) for mating with threads 406 of inner sleeve 400. In certain exemplary embodiments, a face seal (not shown) is present at the top of the threads 406 for controlling the flow and containment of fluids, such as a corrosion inhibitor. In certain embodiments, the threads 218, 406 may be replaced with another mechanical means, such as cap screws, for coupling the inner sleeve 400 to the cap body 200.

Figure 3:
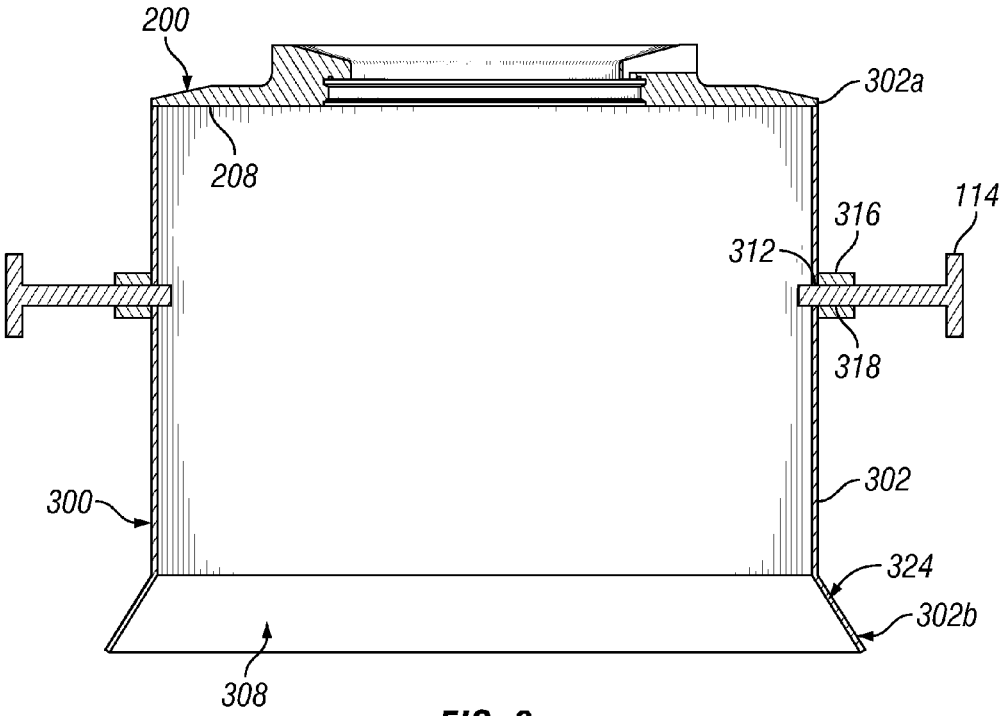
FIG. 3 is a side cross-sectional view of an outer body coupled to the cap body of FIG. 2, according to an exemplary embodiment.

Referring to FIG. 3, the outer body 300 is shown coupled to the cap body 200. The outer body 300 includes a cylindrical wall 302 having an upper end 302*a* and a lower end 302*b* and an opening 308 extending from the upper end 302*a* to the lower end 302*b*. The outer body 300 also includes an outwardly flaring circumferential skirt 324 around the lower end 302*b* to help expedite the installation of the temporary abandonment cap 100 onto the structure to be protected. The upper end 302*a* of the outer body 300 is coupled to the bottom surface 208 of the cap body 200. In certain exemplary embodiments, the outer body 300 is coupled to the cap body 200 by welding the components together. In other embodiments, the outer body 300 is coupled to the cap body by another mechanical means.

The outer body 300 includes two or more circular openings 312 within the cylindrical wall 302 and positioned opposite one another. The size, shape, and configuration of the openings 312 may vary. Each of the openings 312 engages a boss 316 having an opening 318 extending therethrough. The openings 318 align with the openings 312 and are configured to receive locking pins 114 for engaging a wellhead. One having ordinary skill in the art will recognize that the locking pins 114 may be replaced by any other suitable locking mechanism, such as those described with respect to FIGS. 1A-1B above.

Figure 4A:
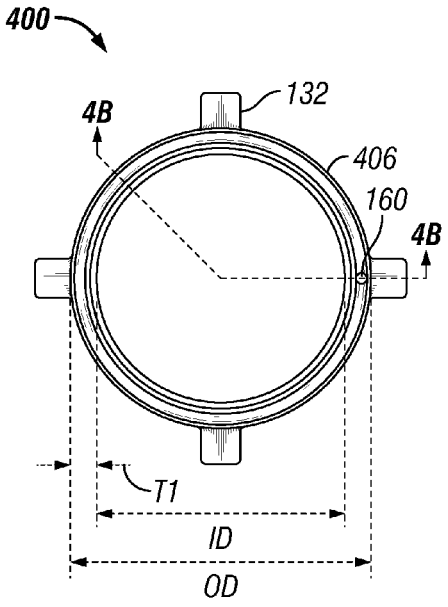
FIG. 4A is a top view of an inner sleeve of the temporary abandonment cap of FIG. 1A, according to an exemplary embodiment.
Figure 4B:
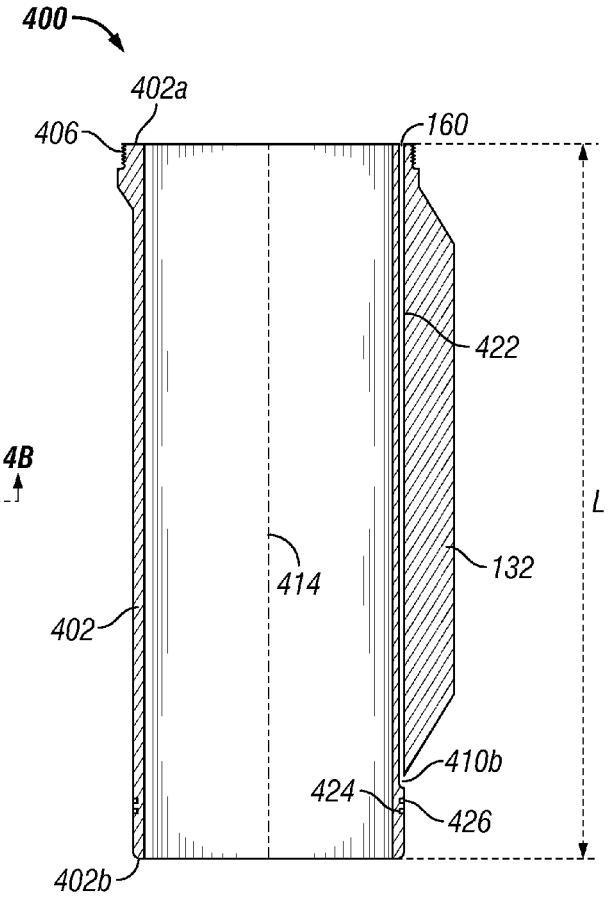
FIG. 4B is a side cross-sectional view of the inner sleeve of FIG. 4A, taken along section A-A of FIG. 4A, according to an exemplary embodiment.

Referring to FIGS. 4A and 4B, an exemplary embodiment of the inner sleeve 400 is shown. The inclusion of the inner sleeve 400 in the temporary abandonment cap 100 allows for access to a wellbore (not shown) while ensuring that the wellhead 700 (FIGS. 7A-7B) remains protected. An outer diameter OD, an inner diameter ID, and a length L of the inner sleeve 400 can be designed depending on the configuration of the wellbore that will be abandoned. Generally, the inner sleeve 400 includes a cylindrical wall 402 having an upper end 402*a*, a lower end 402*b*, and a wall thickness T1. The upper end 402*a* of the cylindrical wall 402 includes threads 406 along the outer diameter for threadably mating with threads 218 of the cap body 200 (FIG. 2B). The inner sleeve 400 also includes a plurality of centralizing wings 132 extending orthogonally from an exterior of the wall 402 and traversing along a portion of a length L of the inner sleeve 400. In certain exemplary embodiments, the inner sleeve 400 includes four centralizing wings 132 spaced 90 degrees apart along the exterior of the inner sleeve 400. The centralizing wings 132 aid in centralizing the internal profile of the components within the temporary abandonment cap 100 around a central axis 414, and provide added stability to the system.

The inner sleeve 400 also includes an injection port 160 in the upper end 402*a* in of the wall 402, and a channel 422 that traverses through the wall 402 from the injection port 160 to a lower end 410*b* of one of the centralizing wings 410. When a fluid is injected into the injection port 160, the fluid travels down through the channel 422 and exits at the lower end 410*b*. Proximate to the lower end 402*b*, the inner sleeve 400 includes grooves 424 for receiving a sealing element 426 (FIG. 4B) for sealingly engaging a casing hanger (not shown) on a wellhead. In certain other embodiments, the inner sleeve 400 is configured to sealingly engage a wellhead without a casing hanger. In certain exemplary embodiments, the sealing element 426 includes an O-ring or any other suitable sealing material as known to one having ordinary skill in the art. Generally, the sealing element 426 is present to influence the path of the fluid(s) passing through the temporary abandonment cap 100.

Referring to FIG. 5, an exemplary embodiment of a junk cap 500 is shown. The junk cap 500 is a removable cover that includes a solid main body 502 having an upper end 502*a* and a lower end 502*b*. A flange 506 extends from the main body 502 at the upper end 502*a*. The flange 506 includes an angled side 508 corresponding to the tapered side of the top portion 210*a* of the opening 210 of the cap body 200 (FIG. 2B). Below the flanged portion 506, the main body 502 is sized to engage the middle portion 210*b* of the opening 210 of the cap body 200. Below the flanged portion 506, the main body 502 includes two grooves 508 for receiving sealing elements 510 for sealingly engaging the cap body 200. In certain exemplary embodiments, the sealing elements 510 include O-rings or any other suitable sealing materials as known to one having ordinary skill in the art. The junk cap 500 also includes a handle 516 affixed to the upper end 502*a* of the main body 502 that allows a user or remotely operated vehicle (not shown) to grasp and manipulate the junk cap 500. In certain exemplary embodiments, the handle 516 is a wire-rope handle.

Referring to FIG. 6, an exemplary embodiment of a hot stab interface 600 is shown. The hot stab interface 600 includes a cylindrical wall 604 surrounding a cavity 606 for receiving a hot stab 608 therein. The wall 604 includes a first port 610 and a second port 612 extending from an inner surface 604*a* of the wall 604, through a thickness T2 of the wall 604, and to an outer surface 604*b* of the wall 604. The first port 610 is configured to align with a corresponding port 154 in the hot stab carrier 152 (FIG. 1B). One having ordinary skill in the art will recognize that any number of hot stab interfaces can be utilized with the temporary abandonment caps of the present invention, and corresponding hot stabs and hot stab carriers can similarly be used.

Figure 7A:
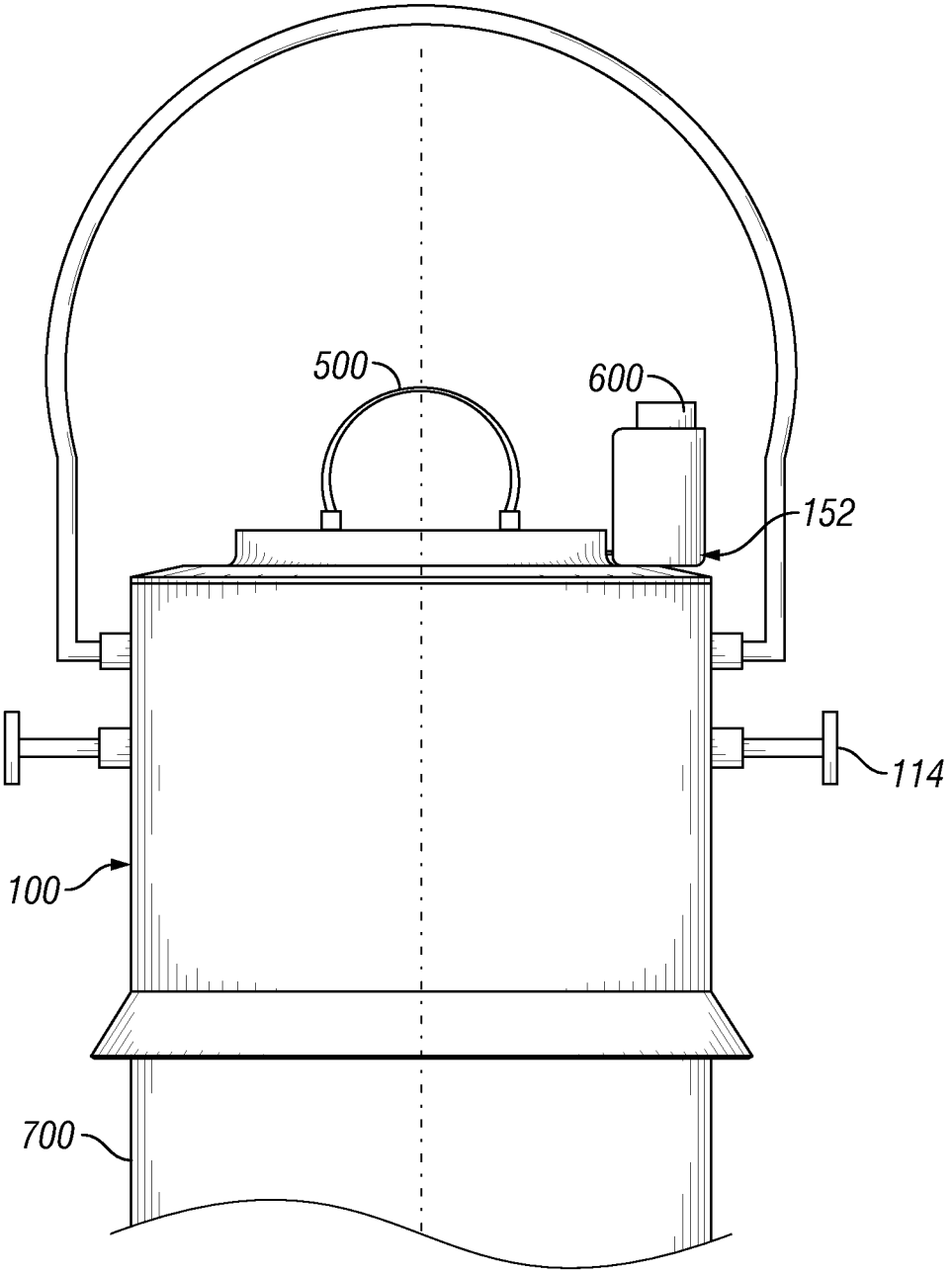
FIG. 7A is a side view of the temporary abandonment cap of FIG. 1A coupled to a wellhead, according to an exemplary embodiment.
Figure 7B:
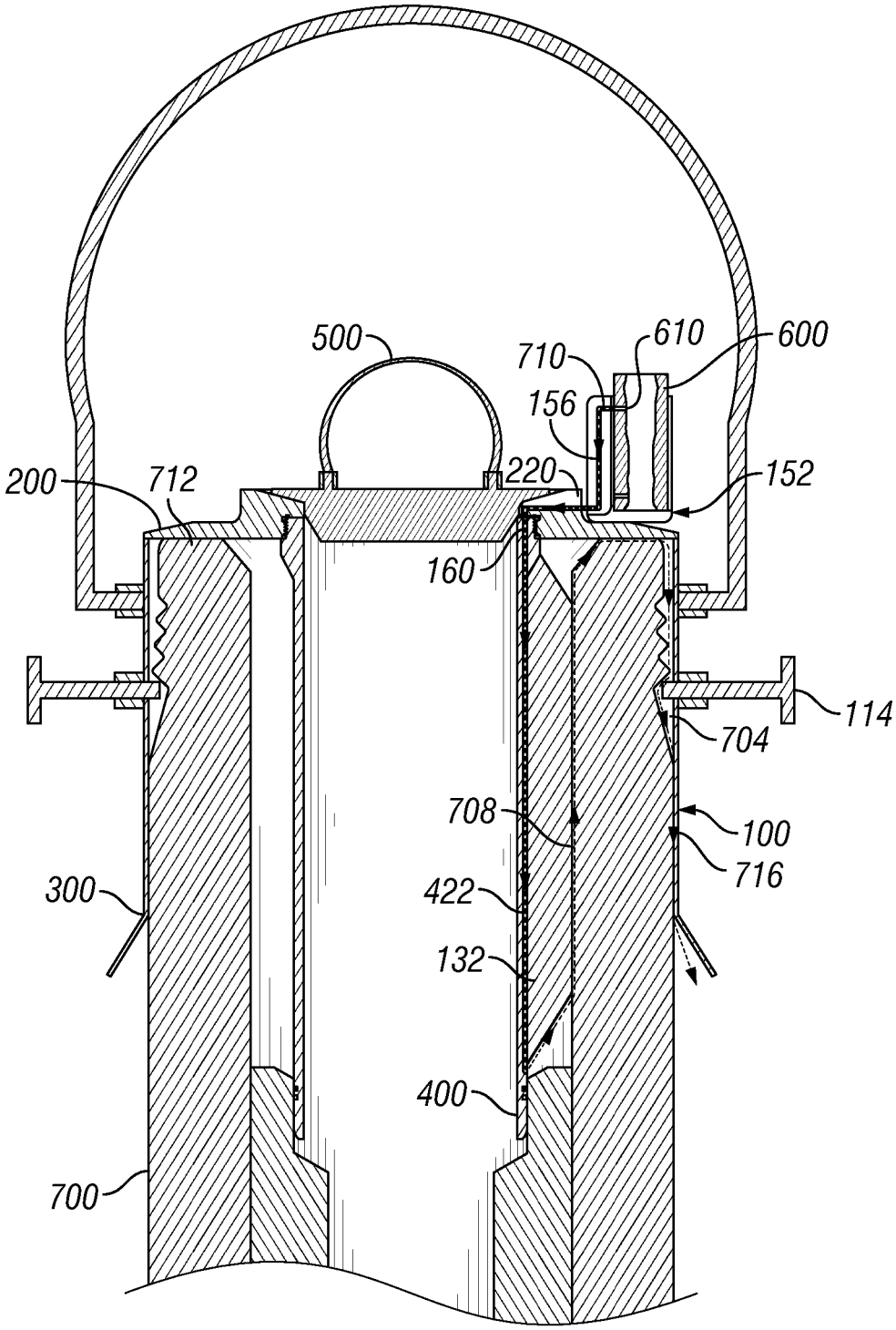
FIG. 7B is a side cross-sectional view of the temporary abandonment cap coupled to the wellhead of FIG. 7A, according to an exemplary embodiment.

Referring now to FIGS. 7A and 7B, the temporary abandonment cap 100 is shown coupled to an open upper end of a subsea structure or wellhead 700. The temporary abandonment cap 100 aids in protecting upper internal and external wellhead 700 sealing surfaces, locking profiles, and other vulnerable components against corrosion. Protection against damage or obstruction by falling debris, silt, and biological accretions is also provided by the temporary abandonment cap 100. The wellhead 700 engages the spacing 120 (FIG. 1B) between the inner sleeve 400 and the outer body 300. The wellhead 700 includes grooves 704 (FIG. 7B) for receiving locking pins 114 to lock the temporary abandonment cap 100 in place. Centralizing wings 132 on the inner sleeve 400 act to position the components of the temporary abandonment cap 100 centrally within the wellhead 700.

Once the temporary abandonment cap 100 is properly seated and locked on the wellhead 700, the next operation involves injecting an anti-corrosion fluid, or corrosion inhibitor, into the well. A suitable example of the anti-corrosion fluid includes, but is not limited to, glycerol. In certain exemplary embodiments, in lieu of, or in addition to, the anti-corrosive fluid, a fluid may be injected for purposes of reducing marine growth on certain surfaces within the well. A hot stab (not shown) engages the hot stab interface 600 and injects the anti-corrosion fluid into the system via the hot stab carrier 152 and a check valve 156. Since the anti-corrosive fluid is typically lighter than seawater, the injected fluid will tend to collect immediately under temporary abandonment cap 100. As more of the fluid is injected, the fluid flows through a fluid path (as illustrated by the arrows in FIG. 7B) described further below, and the seawater in the well is ejected out of the well. In certain alternative embodiments, when the anti-corrosive fluid is heavier than seawater, the fluid on the outside of the wellhead 700 will eventually flow out from underneath the temporary abandonment cap 100 such that the exterior of the wellhead 700 will not have a corrosion inhibitor in place, but the interior of the wellhead 700 will still be protected from corrosion due to the sealing elements in place to prevent the inhibitor from flowing completely out.

The fluid is injected into the first port 610 and enters tubing 710 in the hot stab carrier 152. The overall length of the tubing 710 may vary depending on the size and configuration of the temporary abandonment cap 100. The fluid travels through the tubing 710 in the notch 220 of the cap body 200 and into the injection port 160 of the inner sleeve 400. The fluid travels through the channel 422 in the inner sleeve 400 and exits into the spacing 120. Generally, any lighter fluid travels upward through an interface 708 between the centralizing wings 132 and the wellhead 700. The fluid then travels through an interface 712 between the cap body 200 and the top of the wellhead 700 and then flows down through an interface 716 between the wellhead 700 and the outer body 300.

The junk cap 500 is designed to cover the center borehole through the inner sleeve 400. The junk cap 500 is self-centralizing and can be installed and/or removed by a remotely operated vehicle. The junk cap 500 aids to inhibit debris from entering into the wellbore. When the junk cap 500 is removed, the inner sleeve 400 allows for access to the wellbore while ensuring that the wellhead 700 remains protected against corrosion. In addition to shielding the internal ring gasket profile (the primary seal that isolates the wellbore from the environment when a blowout preventer is installed), the inner sleeve 400 also serves to protect the internal sealing surfaces of the wellhead 700. Since the inner sleeve 400 extends into the wellhead 700, corrosion inhibitor fluid can be pumped into the spacing 120 and left undisturbed through further well activities, until the temporary abandonment cap 100 is completely removed.

Generally, a temporary abandonment cap of the present invention for protection of a subsea wellhead of a wellbore includes an outer body, a cap body, an inner sleeve, and a removable cover. The cap body is coupled to the outer body and the inner sleeve such that a spacing is provided between the outer body and inner sleeve for engaging the wellhead. The cap includes an opening aligned with an opening in the inner sleeve. The inner sleeve includes a channel in communication with a notch in the cap body and an exit port in the inner sleeve. The cap is positioned and lowered over the wellhead so as to provide access to the wellbore through the openings in the cap body and inner sleeve once the removable cover is removed. A fluid is injected into tubing in the notch in the cap body. The fluid flows through the tubing, into the channel in the inner sleeve, exits the inner sleeve, flows up through the inner sleeve-wellhead interface, and flows down through the wellhead-outer body interface and out of the cap. In embodiments where the fluid has a lower density than seawater, any seawater present flows down through the wellhead-outer body interface and out of the cap. In embodiments where the fluid has a greater density than seawater, the fluid generally protects the inner sleeve-wellhead interface and flow out of the cap on the wellhead-outer body interface side. The temporary abandonment cap allows for access to the wellbore while protecting the wellhead components.

The present application is directed to temporary abandonment caps that can remain in place while performing well operations and ensuring that the sealing surfaces on the wellhead remain protected from corrosion. The temporary abandonment caps include a cap body having an opening therethrough, an inner sleeve that provides access to the wellbore, where the inner sleeve can be accessed through the opening in the cap body when a junk cap is removed. The temporary abandonment caps of the present invention streamline operations as they can be installed and secured prior to performing any work on the well. In batch set situations, as well as single wells, the well can be immediately protected after removal of a blowout preventer stack, rather than leaving the well open until all operations are completed, thereby reducing risk or damage to the well.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A cap for covering an open upper end of a subsea structure of a wellbore, comprising:

an outer body having a cavity and sized to fit over said subsea structure;

a cap body coupled to one end of the outer body, wherein the cap body comprises an opening extending therethrough;

an inner sleeve positioned within the cavity of the outer body and coupled to the cap body, the inner sleeve having a hollow portion defined by a sleeve wall, wherein the opening of the cap body provides access to the hollow portion of the inner sleeve and thereby provides access to said wellbore, wherein the sleeve wall of the inner sleeve and the outer body define a spacing for engaging said subsea structure, wherein the inner sleeve comprises an entry port, an exit port, and a channel through the sleeve wall extending from the entry port to the exit port, wherein the cap body comprises a notch in communication with the entry port of the inner sleeve;

a removable cover for covering the opening of the cap body.

2. The cap of claim 1, wherein the inner sleeve comprises one or more wings extending out from the sleeve wall.

3. The cap of claim 1, wherein the inner sleeve comprises a sealing element for sealingly engaging said subsea structure.

4. The cap of claim 3, wherein the sealing element is positioned below the exit port of the inner sleeve.

5. The cap of claim 1 , further comprising tubing positioned within the notch of the cap body, wherein the tubing engages the entry port of the inner sleeve.

6. The cap of claim 1, wherein the opening of the cap body comprises a top portion, a middle portion, and a bottom portion.

7. The cap of claim 6, wherein the top and middle portions are configured to receive the removable cover.

8. The cap of claim 7, wherein the middle portion comprises a sealing element for sealingly engaging the removable cover.

9. The cap of claim 6, wherein the bottom portion comprises a mating element for engaging the inner sleeve.

10. A method for protecting an open upper end of a subsea structure of a wellbore, the method comprising:

positioning a cap above said open upper end of the subsea structure, wherein the cap comprises:

an outer body having a cavity and sized to fit over said subsea structure;

a cap body coupled to one end of the outer body, wherein the cap body comprises an opening extending therethrough;

an inner sleeve positioned within the cavity of the outer body and coupled to the cap body, the inner sleeve having a hollow portion defined by a sleeve wall, wherein the opening of the cap body provides access to the hollow portion of the inner sleeve and thereby provides access to said wellbore, wherein the sleeve wall of the inner sleeve and the outer body define a spacing for engaging said subsea structure, wherein the inner sleeve comprises an entry port, an exit port, and a channel through the sleeve wall extending from the entry port to the exit port; and a removable cover for covering the opening of the cap body;

lowering the cap onto the subsea structure such that the subsea structure engages the spacing between the inner sleeve and the outer body and the hollow portion of the inner sleeve provides access to said wellbore;

inserting a fluid through said entry port of the inner sleeve, wherein the fluid travels through the channel in the inner sleeve, out the exit port, up through an interface of the inner sleeve and subsea structure, and thereby displacing a less dense fluid which flows down through an interface of the subsea structure and outer body and out of said cap.

11. The method of claim 10, wherein the less dense fluid is seawater.

12. The method of claim 10, wherein the inner sleeve of the cap further comprises a sealing element for sealingly engaging the subsea structure.

13. The method of claim 12, wherein the sealing element is positioned below the exit port of the inner sleeve.

14. The method of claim 10, wherein the cap body comprises a notch in communication with the entry port of the inner sleeve.

15. The method of claim 14, further comprising tubing positioned within the notch of the cap body, wherein the tubing engages the entry port of the inner sleeve, and wherein the fluid is injected into the tubing.

16. The method of claim 10, further comprising the step of removing the removable cover to allow a user access to the wellbore through the opening of the cap body and the hollow portion of the inner sleeve.

17. The method of claim 10, wherein the fluid comprises a corrosion inhibitor.

18. The method of claim 10, further comprising the step of locking the cap in place after the cap is lowered onto the subsea structure.

19. A method for protecting an open upper end of a subsea structure of a wellbore, the method comprising:

positioning a cap above said open upper end of the subsea structure, wherein the cap comprises:

an outer body having a cavity and sized to fit over said subsea structure;

a cap body coupled to one end of the outer body, wherein the cap body comprises an opening extending therethrough;

an inner sleeve positioned within the cavity of the outer body and coupled to the cap body, the inner sleeve having a hollow portion defined by a sleeve wall, wherein the opening of the cap body provides access to the hollow portion of the inner sleeve and thereby provides access to said wellbore, wherein the sleeve wall of the inner sleeve and the outer body define a spacing for engaging said subsea structure, wherein the inner sleeve comprises an entry port, an exit port, and a channel through the sleeve wall extending from the entry port to the exit port; and a removable cover for covering the opening of the cap body;

lowering the cap onto the subsea structure such that the subsea structure engages the spacing between the inner sleeve and the outer body and the hollow portion of the inner sleeve provides access to said wellbore;

inserting a fluid through said entry port of the inner sleeve, wherein the fluid travels through the channel in the inner sleeve, out the exit port, up through an interface of the inner sleeve and subsea structure, flows down through an interface of the subsea structure and outer body, and out of said cap.

20. The method of claim 19, wherein the fluid has a density greater than a density of seawater.

21. A cap for covering an open upper end of a subsea structure of a wellbore, comprising:

an outer body having a cavity and sized to fit over said subsea structure;

a cap body coupled to one end of the outer body, wherein the cap body comprises an opening extending therethrough, wherein the opening of the cap body comprises a top portion, a middle portion, and a bottom portion;

an inner sleeve positioned within the cavity of the outer body and coupled to the cap body, the inner sleeve having a hollow portion defined by a sleeve wall, wherein the opening of the cap body provides access to the hollow portion of the inner sleeve and thereby provides access to said wellbore, wherein the sleeve wall of the inner sleeve and the outer body define a spacing for engaging said subsea structure, wherein the inner sleeve comprises an entry port, an exit port, and a channel through the sleeve wall extending from the entry port to the exit port;

a removable cover for covering the opening of the cap body, wherein the top and middle portions of the cap body are configured to receive the removable cover.

* * * * *